US006118062A

United States Patent [19]

Thoman

[11] Patent Number: 6,118,062

[45] Date of Patent: Sep. 12, 2000

[54] ERGONOMIC DRUMSTICK GRIPS

[76] Inventor: James R Thoman, 18516 92nd Ave. NE., Bothell, Wash. 98011

[21] Appl. No.: 09/385,770

[22] Filed: Aug. 30, 1999

[51] Int. Cl.[7] ..... G10D 13/02

[52] U.S. Cl. ..... 84/422.4; D17/99; D17/13

[58] Field of Search ..... 84/422.4; D17/99, D17/13

[56] References Cited

U.S. PATENT DOCUMENTS

| | | | |
|---|---|---|---|
| D. 278,634 | 4/1985 | Anderson | D17/22 |
| 1,484,777 | 2/1924 | Hassenpflug | 84/422.4 |
| 3,175,450 | 3/1965 | Criscuolo | 84/422.4 |
| 3,866,508 | 2/1975 | Huslig | 84/422 |
| 5,696,339 | 12/1997 | Brennan | 84/422.4 |

*Primary Examiner*—Bentsu Ro
*Assistant Examiner*—Kim Lockett
*Attorney, Agent, or Firm*—Richard D. Multer

[57] ABSTRACT

Ergonomic drumstick grips which reduce the fatigue, discomfort, and pain experienced by a drummer wielding drumsticks, particularly over an extended period of time. The grip is an elongated, tubular member designed to be retained securely in place on a drumstick by friction between the grip and the stick. Various features of the ergonomic grip provide rests for the base and forward parts of the drummer's thumb, while allowing the pads of at least the drummer's forefinger and index finger to directly contact the drumstick for added control. All five of the drummer's digits fall into comfortable and natural positions when a drumstick equipped with the ergonomic grip is grasped. The grips may be provided in pairs with the grips in the pair configured to fit the drummer's left hand and right hands.

15 Claims, 3 Drawing Sheets

ERGONOMIC DRUMSTICK GRIPS

TECHNICAL FIELD OF THE INVENTION

The present invention relates to novel, improved, ergonomic drumstick grips.

BACKGROUND OF THE INVENTION

It is common for drummers' hands to become fatigued and sore after playing for an extended period of time. Often, the pain persists; and a chronic condition develops.

Numerous attempts to reduce the discomfort and pain brought on by extended periods of drumming have been made. To this end, drummers have cut grooves in drumstick handles, wrapped the handles with tape of the type more commonly applied to bicycle grips, and experimented with a variety of rubber grips. None of these approaches have proved satisfactory. Grooves, tapes, and many grips can make the drumsticks awkward and difficult to handle skillfully. Furthermore, the grips here before proposed have tended to be heavy and cumbersome and therefore unsatisfactory. Consequently, there's a continuing and existent need for an accessory or other approach which can be employed to reduce, if not eliminate, fatigue and pain in a drummer's hands.

SUMMARY OF THE INVENTION

A solution to the hand fatigue and pain problem discussed above has now been developed and is disclosed herein.

Generally speaking, the present invention provides ergonomic grips which can be readily installed on the handles of conventional drumsticks. The grips are formed from a rubber-like polymeric material and are configured such that the drummer's hands automatically fall into a natural attitude when the drumstick is gripped. Because of this and the light weight of the grip, the drummer's ability to manipulate a drumstick is not adversely affected and may even be enhanced. It is also important that the novel ergonomic grips disclosed herein are relatively easy and inexpensive to manufacture, yet are durable and consequently have an extended service life.

The objects, advantages, and features of the invention will be apparent to the reader from the foregoing, the appended claims, and the ensuing detailed description and discussion of the invention as it proceeds in conjunction with the accompanying drawing.

DETAILED DESCRIPTION OF THE INVENTION

Figure 1:
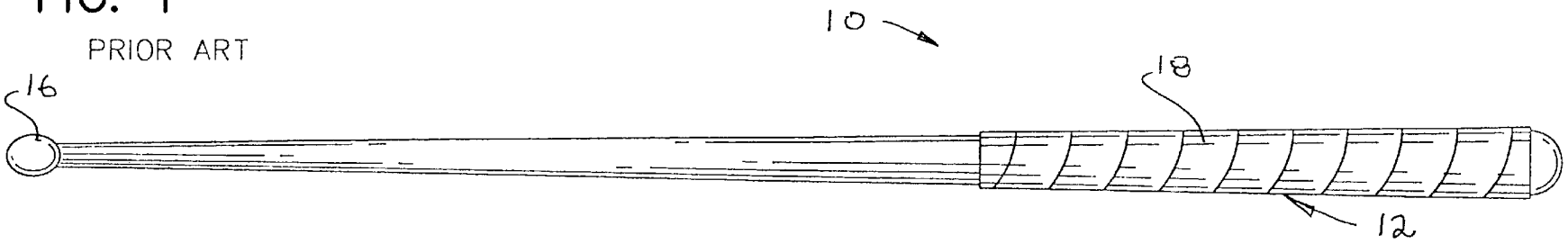
FIG. 1 PRIOR ART
FIG. 1 is a plan view of a conventional drumstick wrapped with tape as has heretofore been done in mostly unsuccessful efforts to reduce the discomfort and pain experienced during extended periods of drumming.

Referring now to the drawing, FIG. 1 depicts a drumstick 10 of conventional construction. The drumstick has a handle 12 which segues into a tapered shaft 14. At the end of shaft 14 opposite handle 12 is an integral tip 16 with which the drum, cymbal, or other percussion instrument is struck. As discussed above, drumsticks of the type illustrated in FIG. 1 are commonly wrapped with bicycle grip tape, identified by reference character 18, in a mostly unsuccessful effort to reduce the discomfort which a drummer may experience after playing for an extended period of time.

Figure 2:
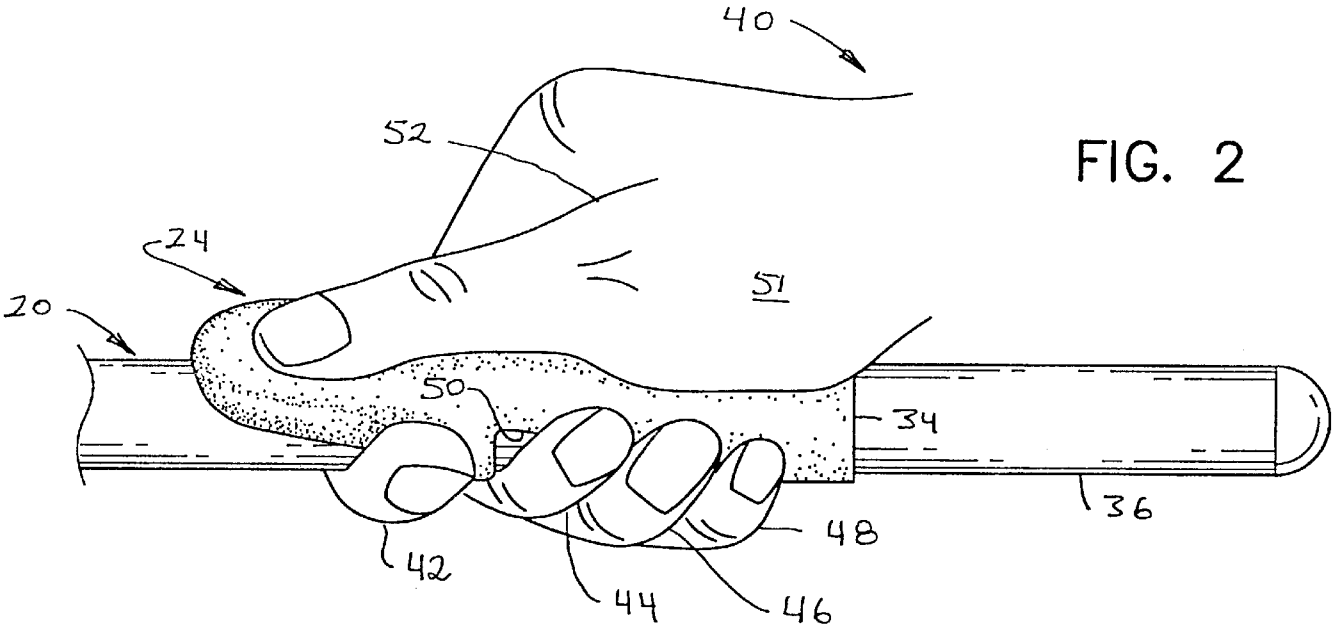
FIG. 2 is a fragmentary view of a drumstick such as the one depicted in FIG. 1, but equipped with an ergonomic grip constructed in accord with the principles of the present invention and configured to significantly enhance the comfort experienced by a drummer, especially one drumming for lengthy periods of time.

Referring still to the drawing, FIG. 2 depicts a drumstick 20 of the type discussed above but with the ineffective wrapping 18 of drumstick 10 replaced with an ergonomic grip 24 constructed in accord with, and embodying, the principles of the present invention.

Grip 24 is an elongated, component with a rest or cushion 26 for the fleshy part of the drummer's thumb; i.e., that part of the thumb generally coextensive with the metacarpus. The thumb rest transitions into an elongated, dished out, thumb rest segment 28 dimensioned to support and cushion the forward part of the drummer's thumb; i.e., that part of the thumb generally commensurate in length with the thumb's phalanges.

Figure 4:
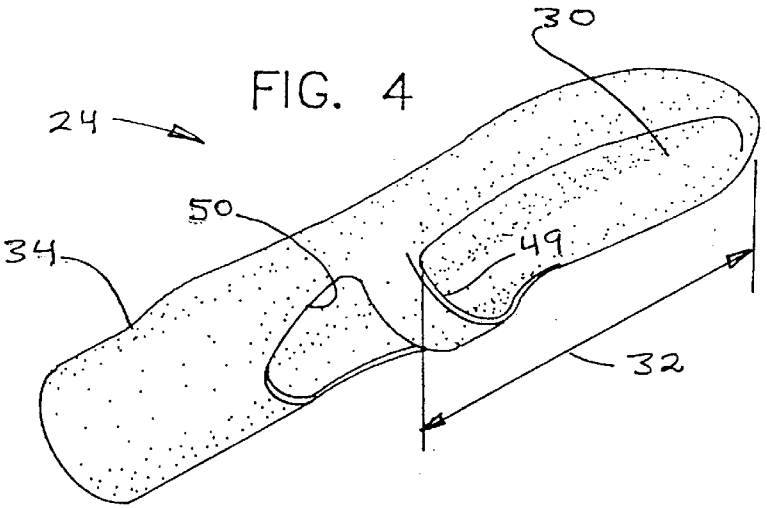
FIG. 4 is an isometric view showing primarily that reverse side of the grip which fits the drumstick handle when the grip is installed.
Figure 3:
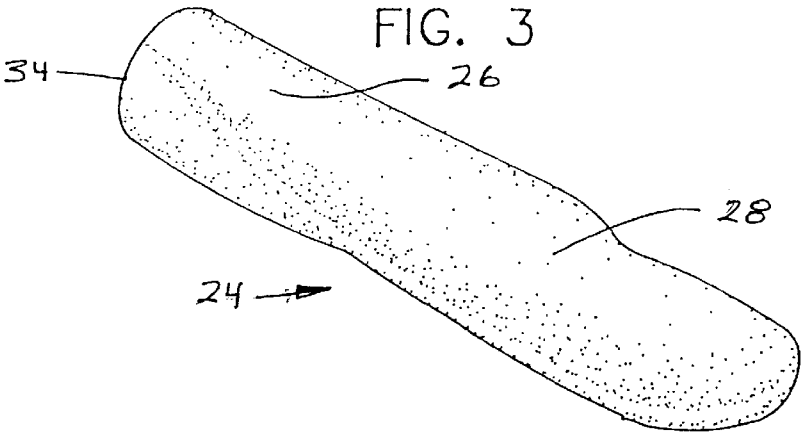
FIG. 3 is an isometric view, showing the exposed, obverse side of the FIG. 2 ergonomic grip.

Referring now more specifically to FIGS. 3 and 4, the reverse or drumstick side of ergonomic grip 24 has an elongated, concave configuration 30 over the major part of the ergonomic grip as indicated by reference character 32. Beyond this part of the grip and continuing to the rear of the grip is a hollow, tubular segment 34 which fits over the handle 36 of drumstick 20 with the ergonomic grip 24 being frictionally retained in place in the location shown in FIG. 2.

Ergonomic grip 20 can be fabricated from any of a wide variety of rubberlike elastomers capable of absorbing the shock and vibration engendered by the impact of drumstick 20 on the instrument being played. Currently preferred, though by no means essential, is an 80 Durometer polyurethane. Such polyurethane's are commercially available from a number of vendors.

Figure 5:
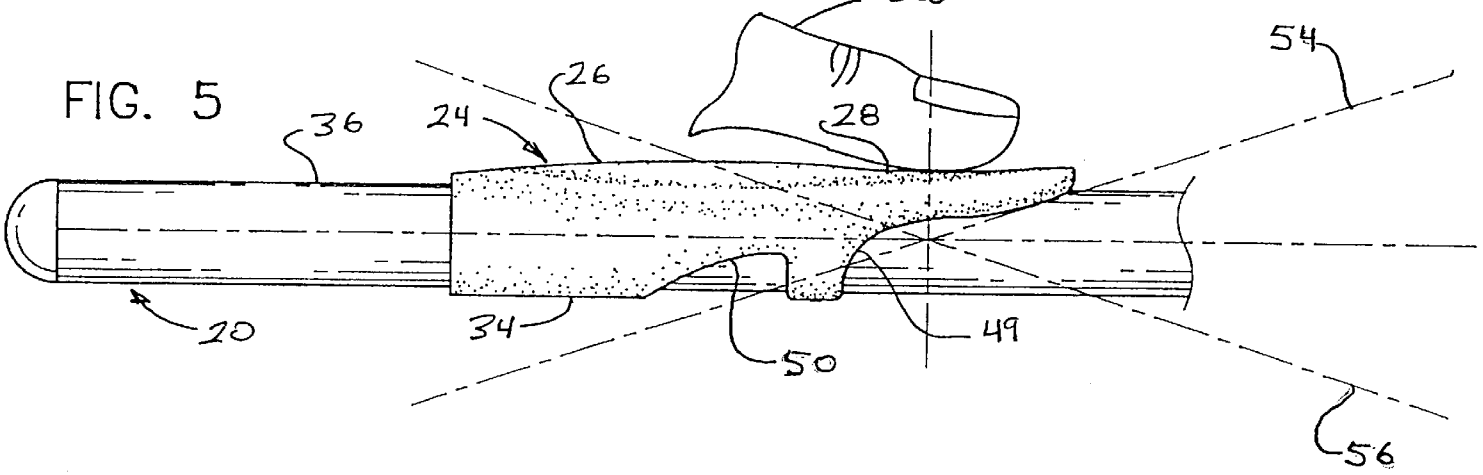
FIG. 5 is a view similar to FIG. 1 but showing alternate orientations which a drummer's thumb may assume in the course of a drumming session.

Referring now specifically to FIGS. 2 and 5, a drummer grips a drumstick 20 equipped with ergonomic grip 24 in the same manner as the drummer would were the grip not present. With the drumstick 20 thus held in the drummer's hand 40, the drummer's fingers 42 . . . 48 are wrapped around the grip with the forefinger 42 abutting the complementarily curved forward end 49 of tubular grip segment 34 and the index finger 44 lying in a cutout 50 provided in the aft tubular segment 34 of the ergonomic grip. Forefinger 42 and index finger 44 are therefore in direct contact with drumstick 20, guaranteeing a firm grip and accurate control of the drumstick.

The fleshy part 51 of the drummer's thumb is seated on rest 26, providing a solid, yet cushioned and comfortable contact between the thumb and grip 24. The forward part 52 of the drummer's thumb extends axially along grip 24 in the grooved or dished out thumb rest 28 of the grip, again providing secure contact with, and accurate control over the movement of, drumstick 20.

The digits of hand 40 are in natural, uncramped positions and locations with drumstick 20 held as shown in FIG. 2. Forefinger 42 and index finger 44 tend to be accurately retained in these illustrated, natural positions by the forefinger being butted against tubular grip segment 34 and by index finger 44 being located in the cutout 50 of that segment. And ergonomic grip 24 is fabricated from a resilient, comfortable polymeric material. Therefore, drumstick 20 can be wielded for an extended period of time without the drummer experiencing the discomfort and/or pain which drummers have come to expect when using unprotected drumsticks or those equipped with prior remedies for hand fatigue, discomfort, and pain such as the tape wrapping 18 shown in FIG. 1.

The two inclined lines 54 and 56 in FIG. 5 identify the limits of movement which drumstick 20 might ordinarily experience with respect to the drummer's hand 40 in the course of a drumming session. As will be apparent to the reader from FIG. 5, ergonomic grip 24 readily accommodates this requisite relative movement while still affording complete control over drumstick 20 by virtue of the forward part 52 of the drummer's thumb being securely positioned and cushioned in thumb rest 28 over this entire range of movement.

Figures 6, 7, 8, 9:
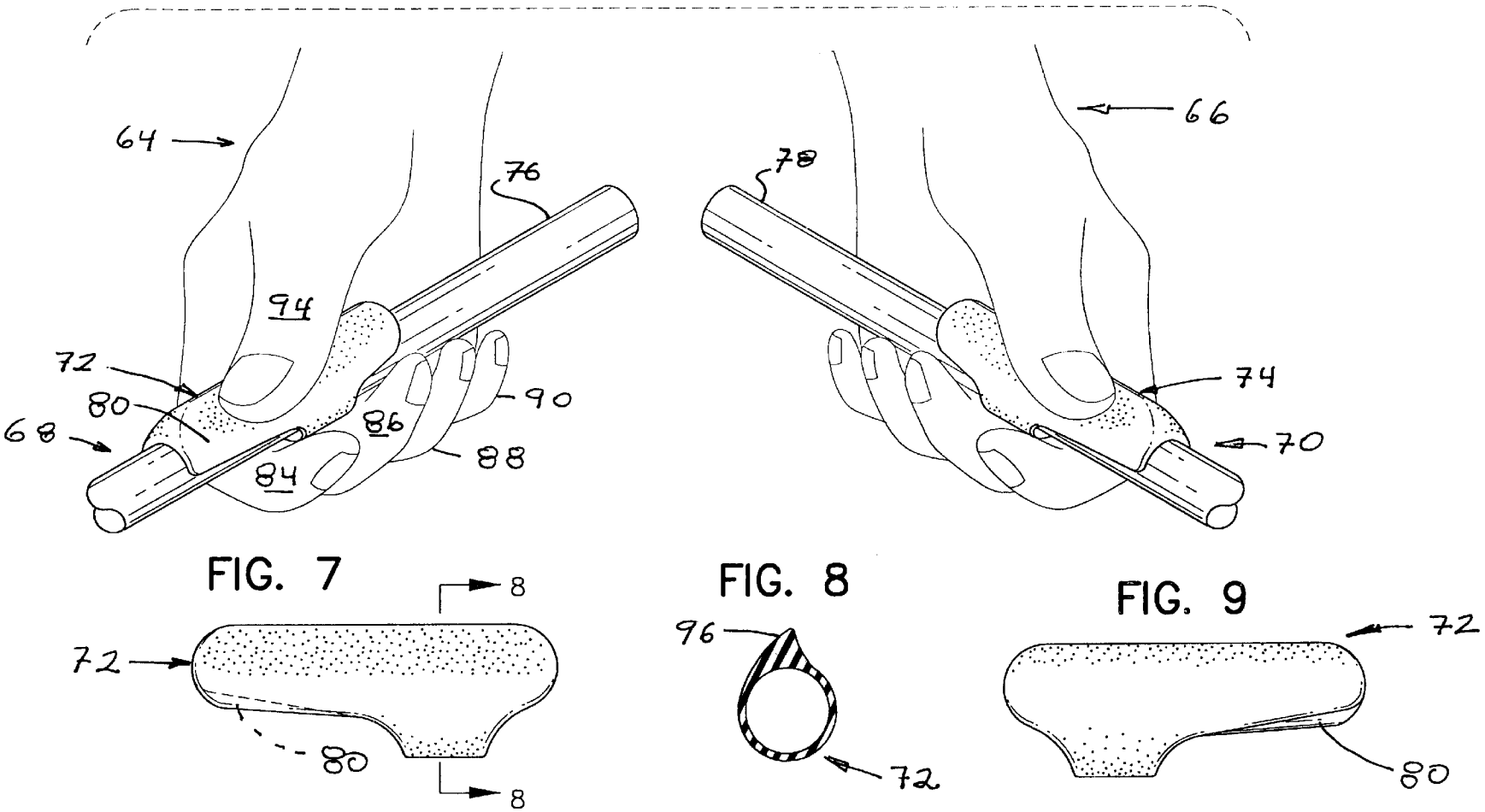
FIG. 6 is a pictorial view of a drummer's hands and a pair of drumsticks equipped with a second specie of ergonomic grips embodying the principles of the present invention; these grips are respectively configured to fit the right hand and the left hand of the drummer.
FIG. 7 is a front view of the right-hand grip shown in FIG. 6.
FIG. 8 is a section taken along line 8—8 through the right hand grip.
FIG. 9 is a rear view of the right-hand grip.

Referring still to the drawing, FIG. 6 depict a drummer's right and left hands 64 and 66 wielding drumsticks 68 and 70, both equipped with complementary drumstick grips embodying the principles of the present invention. The right-hand grip 64 (see FIGS. 7–9) is identified by reference character 72 and the left-hand grip by reference character74. These grips are installed on the handles 76 and 78 of drumsticks 68 and 70.

Ergonomic grip 72 differs from the grip 24 illustrated in FIGS. 1–5 and discussed above primarily in that the it has a single, elongated cutout 80 for the drummer's right-hand fingers 84, 86, 88, and 90. With this modification, the grip is more versatile in that it will fit a greater variety of hand shapes, thus making the grip feel better to more people while retaining the advantage of providing a secure grip for the drummer's hand. Also, the modification just discussed provides flexibility by allowing the drummer to shift his hand 64 along grip 72 instead of the hand being constrained in a cutout as it is in the case of ergonomic grip 24. The drummer may, for example, shift his or her hand 64 along grip 72 to a location which allows the forefinger 84 and index finger 86 of hand 64 to directly contact the handle 76 of drumstick 68. This may be perceived by the drummer to afford still better control over drumstick 10.

Control of the drumstick 68 equipped with ergonomic grip 72 is also promoted by the dished out recess (or cutout) 80 extending the length of grip 72. This dishing out of ergonomic grip 72 provides a secure rest for the thumb 94 of the drummer's hand 64 while leaving sufficient material between the grip and drumstick 68 to cushion the drummer's thumb.

Grip 72 also differs from grip 24 in that it has an integral, wedge-shaped cushioning segment 96 extending the length of the grip. This segment is trapped between the thumb 94 and forefinger 84 of the drummer's hand 64. This also promotes a secure grip and accurate control of drumstick 72.

The ergonomic, left-hand grip 74 shown in FIG. 6 has a mirror image configuration relative to grip 72 and is intended to be installed on the handle 76 of left-hand drumstick 66. Because of the two grips are otherwise essentially identical, grip 76 will not be described further in this specification.

With the exceptions discussed above, ergonomic grips 74 and 76 may essentially duplicate ergonomic drumstick 24, and they have the novel advantages of that drumstick.

The invention may be embodied in many forms without departing from the spirit or essential characteristics of the invention. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

What is claimed is:

1. The combination of: (a) a drumstick comprising a handle and a tip, and (b) a removable, ergonomic grip for said drumstick:

said grip being fabricated from a resilient, yieldable, polymeric material;

said grip having an elongated tubular form configured and dimensioned to fit on the handle of said drumstick;

said grip having an elongated segment which extends longitudinally along the drumstick handle and is configured on a reverse side to complement the exterior configuration of the drumstick handle;

the obverse side of said segment having therein an elongated, longitudinally extending, dished out, thumb-receiving recess with there being sufficient material between the inner reaches of said recess and the reverse side of the grip to cushion a user's thumb; and there being a cutout in said grip on the opposite side of the grip from said thumb-receiving recess which allows at least one of the user's fingers to directly contact said drumstick handle while cushioning the user's fingers.

2. A combination as defined in claim 1 in which the thumb-receiving recess of the ergonomic grip extends from end to end of the grip.

3. A combination as defined in claim 1 in which:

said ergonomic grip has a forward end and a rearward end; and there are separate cutouts extending to said forward and rearward ends which allow different ones of the drummers fingers to directly contact the drumstick.

4. A combination as defined in claim 1 in which the ergonomic grip has a longitudinally extending, integral, cushioning, wedge-shaped element which is adapted to be trapped between the thumb and forefinger of a drummer's hand.

5. An ergonomic drumstick grip fabricated from a resilient, yieldable, polymeric material:

said grip having an elongated tubular form and being configured to fit on a drumstick handle;

said grip having an elongated segment which is configured on the reverse side thereof to complement the external configuration of the drumstick handle;

the obverse side of said segment having therein an elongated, longitudinally extending, dished out, thumb-receiving recess;

there being cushioning material between the inner reaches of said recess and the reverse side of the grip; and there being drumstick exposing cutouts for a user's forefinger and index finger on the side of the grip opposite said recess;

said cutouts being so configured as to leave cushioning material for the user's hand.

6. An ergonomic drumstick grip as defined in claim 5 wherein there are first and second cutouts and said cutouts extend to opposite ends of the grip.

7. An ergonomic drumstick grip as defined in claim 5 which has a longitudinally extending, integral, wedge-shaped element adapted to be trapped between the thumb and forefinger of a drummer's hand.

8. A pair of ergonomic drumstick grips:

each said grip being fabricated from a resilient, yieldable, polymeric material;

each said grip having an elongated tubular form and being configured to fit in a drumstick handle;

each said grip having an elongated segment which is configured on the reverse side thereof to complement the external configuration of the drumstick handle;

the obverse side of said segment having therein an elongated, longitudinally extending, dished out, thumb receiving recess;

there being cushioning material between the inner reaches of said recess and the reverse side of the grip; and there being drumstick exposing cutouts for a user's forefinger and index finger on the side of the grip opposite said recess;

said cutouts being so configured as to leave cushioning material for the user's fingers; and said grips being configured in mirror image relationships to fit a user's left and right hands.

9. Ergonomic drumstick grips as defined in claim 8 wherein there are first and second cutouts in each of the grips and wherein said cutouts extend to opposite ends of the grip in which they are provided.

10. Ergonomic drumstick grips as defined in claim 8 wherein each of the grips has a longitudinally extending, integral, wedge-shaped element which is adapted to be trapped between the thumb and forefinger of a drummer's hand.

11. Ergonomic drumstick grips as defined in claim 10 wherein the integral, wedge-shaped elements of the grips are in a mirror image relationship and are thereby adapted to be respectively trapped between the thumb and forefinger of a user's left hand and the thumb and forefinger of the drummer's right hand.

12. In combination: a pair of drumsticks and a removable, ergonomic grip for each of said drumsticks:

each of said drumsticks comprising a handle;

one of said grips being installed on the handle of one said drumsticks and the other of said grips being installed on the handle of the said drumsticks;

each of said drumsticks having a cutout which allows a drummer's finger to directly contact the drumstick on which the grip is installed and an integral element which is adapted to be trapped between the thumb and forefinger of a drummer's hand; and said grips having mirror image configurations to match them to the drummer's left and right hands.

13. A combination as defined in claim 12 wherein the ergonomic grips are fabricated from a yieldable, resilient, ergonomic material.

14. A combination as defined in claim 12 wherein:

each said grip has an elongated segment which is configured on the reverse side thereof to complement the external configuration of the drumstick handle; and the obverse side of said segment has an elongated, longitudinally, dished out, thumb-receiving recess;

there being cushioning material between the inner reaches of said recess and the reverse side of the grip; and there being drumstick exposing cutouts for a user's forefinger and index finger on the side of the grip opposite said recess;

side cutouts being so configured as to leave cushioning material for the user's fingers.

15. A combination as defined in claim 14 wherein there are first and second cutouts in each of said ergonomic grips and said cutouts extend to opposite ends of the grip in which they are formed.

* * * * *